US006284311B1

(12) United States Patent
Gregorovich et al.

(10) Patent No.: US 6,284,311 B1
(45) Date of Patent: Sep. 4, 2001

(54) PROCESS FOR APPLYING POLYMER PARTICLES ON SUBSTRATE AND COATINGS RESULTING THEREFROM

(75) Inventors: Basil Volodymyr Gregorovich; George Kevork Kodokian, both of Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/155,719

(22) PCT Filed: Apr. 8, 1997

(86) PCT No.: PCT/US97/05725

§ 371 Date: Oct. 5, 1998

§ 102(e) Date: Oct. 5, 1998

(87) PCT Pub. No.: WO97/37776

PCT Pub. Date: Oct. 16, 1997

Related U.S. Application Data

(63) Continuation-in-part of application No. 08/629,205, filed on Apr. 8, 1996.

(51) Int. Cl.[7] ..... B05D 1/24

(52) U.S. Cl. ..... 427/185; 427/314; 427/318; 427/459

(58) Field of Search ..... 427/185, 314, 427/318, 459; 118/DIG. 5

(56) References Cited

U.S. PATENT DOCUMENTS

| | | | | |
|---|---|---|---|---|
| 3,264,131 | * | 8/1966 | Nagel et al. . | |
| 3,331,891 | | 7/1967 | Thomas et al. | 260/862 |
| 3,481,756 | * | 12/1969 | Kong . | |
| 3,862,862 | * | 1/1975 | Gillibrand et al. . | |
| 3,985,097 | * | 10/1976 | Sitton . | |
| 4,056,653 | * | 11/1977 | Gebhard, Jr. et al. . | |
| 4,072,795 | | 2/1978 | Noonan | 428/379 |
| 4,185,000 | | 1/1980 | Gebauer et al. | 260/42.27 |
| 4,255,462 | | 3/1981 | Gebauer et al. | 427/27 |
| 4,268,579 | | 5/1981 | Suzuki et al. | 428/413 |
| 4,414,351 | | 11/1983 | Suzuki et al. | 524/413 |
| 4,885,187 | * | 12/1989 | Koenig . | |
| 4,911,949 | * | 3/1990 | Iwase et al. . | |

FOREIGN PATENT DOCUMENTS

| | | | |
|---|---|---|---|
| 1473395 | | 6/1967 | (FR) . |
| 1501696 | | 3/1975 | (GB) . |
| 1 501 696 | * | 2/1978 | (GB) . |
| 2 042 930 | | 2/1980 | (GB) . |
| 61-187975 | | 8/1986 | (JP) . |

OTHER PUBLICATIONS

"Fluidised Bed Powder Coating", M. Elmas, pp. 27–29, powder Technology Publication Series No. 5, Jun. 1973.*

A. H. Landrock, Fluidized Bed Coating with Plastics, *Engineering Progress*, 63, 67–74, Feb. 1967.

Josef H. Jilek, Powder Coatings, *Federation of Societies for Coatings Technology*, 7–35, Oct. 1991.

Cohen et al., Powder Technology, *Encyclopedia of Chemical Technology*, 6, 635–661, 1993.

Douglas S. Richart, A Report on the Fluidized Bed Coatings System—Part 2 Plastics for Coating and Their Selection, *Plastics Design & Processing*, 26–34, Jul. 1962.

Nicholas P. Liberto, Power Coating Equipment—Part I Application, *Metal Finishing*, 23–27, Aug. 1990.

* cited by examiner

*Primary Examiner*—Fred J. Parker

(57) ABSTRACT

A heated substrate is dipped into a fluidized bed containing particles of polymer to coat the substrate. The coating can subsequently be leveled (and cured if thermosetting) by heating the coated substrate above the melting point of the polymer. The process can be employed to provide desirable properties such as corrosion resistance and aesthetic qualities to the substrate, and to apply very thin coatings.

21 Claims, No Drawings

PROCESS FOR APPLYING POLYMER PARTICLES ON SUBSTRATE AND COATINGS RESULTING THEREFROM

This application is a 35 USC §371 of PCT/US97/05725 filed on Apr. 8, 1997, which is a continuation-in-part application of Ser. No. 08/629,205 filed on Apr. 8, 1996.

BACKGROUND OF THE INVENTION

Described herein is a process for coating a substrate with a polymer by immersing a heated substrate in a fluidized bed of polymer particles. After removal of the coated substrate from the fluidized bed, additional heat can be applied to level the coating and, if the polymer is thermosetting, to effect cure.

The coating of substrates, such as metals, is useful for aesthetic purposes and for practical purposes such as corrosion protection. Many types of coating materials and processes for utilizing these coating materials are known in the art. For environmental reasons, there is a trend to using coating materials that emit low levels of organic volatiles, and preferably no volatiles at all, during the coating process.

One method which creates low levels of volatiles in the coating process is powder coating applied by fluidized bed. One drawback to the process as it is currently practiced is that relatively thick coatings are produced because of the lack of appreciation of how to control coating thickness to consistently obtain thinner coatings. In order to overcome this shortcoming, electrostatic spraying is sometimes used. However, the electrostatic process requires elaborate equipment, and does not typically coat all surfaces within an object.

Descriptions of typical powder coating methods are found in Jilek, "Powder Coatings", Federation of Societies for Coating Technology, Blue Bell, Pa., U.S.A., October 1991, pages 7 to 35; Landrock in Encyclopedia of Polymer Science and Technology, Vol. 3, McGraw Hill Book Co., New York, 1965, pages 808 to 830; Landrock in Chem. Eng. Progress, Vol. 63, No. 2, pages 67 to 73; Richart, Plastics Design and Processing, July 1962, pages 26 to 34; and Kroschwitz, Ed., Kirk-Othmer Encyclopedia of Chemical Technology, 4th Ed., Vol. 6., John Wiley & Sons, New York, 1993, pages 635 to 661. Fluidized beds are well-known in the art, see for instance, Elvers, et al, Ed., Ullmann's Encyclopedia of Industrial Chemistry, 5th Ed., Vol. B4, VCH Verlagsgesellschaft mbH, Weinheim, 1992, pages 240 to 274. With respect to making spherical particles of copolymer, see U.S. Pat. No. 3,933,954 and U.S. Pat. No. 4,056,653.

None of these references describes a fluidized bed process into which is dipped a substrate, heated just to the temperature at which it causes tackiness of the polymer particles that contact the substrate, or modestly higher, together with control of the particle size. By heating the substrate significantly above the melting point of the polymer, the art regularly achieves coating thicknesses exceeding what is useful in certain practical applications. For instance, typical procedures taught in the art produce coatings too thick for automotive applications, as well as other applications where thicknesses of 150 micrometers, even significantly below 150 micrometers, are desired. This deficiency has been a primary factor in slowing the growth of powder coating applications.

SUMMARY OF THE INVENTION

This invention concerns an improvement in a process for coating a substrate with a polymer comprising immersing a heated substrate into a fluidized bed of particles of the polymer, coating the substrate with the polymer and removing the coated substrate from the fluidized bed; the improvement comprising:

i) heating the substrate to a temperature sufficient to tackify the polymer particles upon contact with the substrate;

ii) maintaining particle temperature in the fluidized bed below that at which the particles tackify;

iii) covering substantially uniformly all surfaces of the substrate;

iv) optionally heating the coated substrate to level the coating and to cure the polymer if it is thermosetting; and v) controlling the coating thickness, per unit time, in this manner:

(a) to obtain relatively thin coatings of up to about 150 micrometers, heat the substrate such that the coating temperature is within the tack temperature gradient but below Tm and maintain particle sizes so that at least 80 weight percent are between 10 to 80 micrometers;

(b) to obtain thicker coatings, heat the substrate above the tack temperature gradient, employ larger particle sizes than described immediately above, or both.

The buildup in coating thickness is believed to result primarily from substrate heating profiles above the tack temperature gradient of the polymer. By "tack temperature" (Tt) is meant the substrate temperature just high enough to cause the polymer particles to adhere thereto. The "tack temperature gradient" comprises a temperature range whose lower limit is the tack temperature and whose upper limit is about 75° C. higher, provided it remains below Tm (melt temperature). One skilled in the art will appreciate that Tm has relevance with respect to crystalline and semicrystalline polymers, not amorphous polymers. Accordingly, when an amorphous polymer has been selected as the coating, the important considerations, so far as temperature is concerned, are Tt and tack temperature gradient.

It is a preferred embodiment of this invention to control coating thickness as described in paragraph v above to obtain thicknesses of 150 micrometers or less. The preferred process involves steps i) through v)(a).

This invention also concerns preferred embodiments wherein the process is operated to coat a galvanized steel substrate, treated or untreated; a substrate having a curved shape with recesses; a substrate which is an automobile body or component thereof; in which the polymer is semicrystalline thermoplastic or semicrystalline thermosetting or amorphous thermoplastic or amorphous thermosetting. When the polymer is thermosetting, the substrate to be coated is immersed into the fluidized bed at a temperature that is controlled so as to effect adherence of the polymer but without substantial crosslinking while the substrate is within the bed.

It is a preferred aspect of this invention to coat a substrate of a vehicle body or component thereof having a curved shape and recesses comprising:

i) applying a coating to the substrate by immersing the heated substrate into a fluidized bed of particles and adhering the particles substantially uniformly to all surfaces of the substrate to produce a coating with an average thickness not exceeding about 150 micrometers;

ii) optionally applying a pigmented basecoat or monocoat to the substrate coated in step i); and iii) optionally applying an unpigmented topcoat to the substrate coated in steps i) and ii).

A preferred basecoat comprises water-borne or solvent-borne polymer; a preferred clear topcoat comprises water-borne, solvent-borne or powder polymer. The invention also concerns optionally pre-treating or post-treating the coated substrate with a primer-surfacer and/or post-treating with a colored basecoat and/or a clear topcoat.

Preferred elements of the claimed process comprise one or more of the following: using fumed silica as a component of the fluidized bed at weight percentages typically between about 0.1 to 0.5 percent; vibrating the part exposed to the fluidized bed to facilitate even coating; and employing spherical particles which have been found to produce the best coating quality.

One of the strategies to obtain the best coatings is to control all variables so that the derived coating in the targeted thickness is deposited independently of dwell time of the substrate in the fluidized bed.

DETAILS OF THE INVENTION

The material coated on the substrate is a polymer powder which is crystalline or amorphous. By crystalline is meant that the polymer has a heat of melting of at least 2 J/g, preferably at least 5 J/g when measured by the Differential Scanning Calorimetry (DSC) using ASTM D3417-83. Such crystalline polymers often contain considerable amounts of amorphous (uncrystallized) polymer. The Tg referred to herein is measured by the method described in ASTM D3417-83 and is taken as the middle of the transition. The Tg described is the highest Tg for the polymer, if the polymer has more than one Tg. If the Tg is undetectable by DSC, Thermomechanical Analysis can be used to determine the Tg, using the same heating rate as is used in DSC. The Tm of the polymer is taken as the end of melting, where the melting endotherm peak rejoins the baseline, when measured by ASTM D3417-83. An amorphous polymer is one which does not contain crystallinity when measured by DSC, or whose heat of melting is less than 2 J/g. Tg is measured by the same method used for crystalline polymers. The polymers employed in the process of this invention can be one or more thermoplastics or one or more thermosets, or a combination of both. If more than one polymer is used, the (first) temperature of the substrate should be in the tack temperature gradient of each of these polymers if each of them is to be a significant part of the resulting coating.

Useful polymers include: thermoplastics such as polyolefins, poly(meth)acrylates [the term (meth)acrylates includes acrylates and methacrylate esters and amides, and acrylic and methacrylic acids], copolymers of olefins and (meth)acrylates, polyamides, polyesters, fluorinated polymers, polyimides, polycarbonates, polyarylates, poly (etherketones), poly(methylpentene), poly(phenylene sulfide), liquid crystalline polymers, polyacetals, cellulosic polymers such as cellulose acetate butyrate, chlorinated polymers such as chlorinated polyethylene, ionomers, styrene(s), and thermoplastic elastomers (below the Tm of the hard segments); and thermosets such as di- and polyhydroxy compounds, monomers, oligomers and polymers including polyacrylates, polymethacrylates, polyethers, polyesters and polyurethanes together with urea formaldehyde, melamine formaldehyde and blocked isocyanate; di- and polycarboxylic acid compounds, monomers, oligomers and polymers including polyacrylates, polymethacrylates, polyethers and polyesters together with epoxy, urea formaldehyde and/or melamine formaldehyde;

and epoxy and phenolic compounds, monomers, oligomers and polymers. Preferred polymers are selected from thermoplastic polyolefin polymers and copolymers, poly (meth)acrylates, polyesters, and polyvinyl chloride, and thermosetting polymers selected from the group consisting of acid-containing polyester/epoxy, hydroxy acrylate/blocked isocyanate or melamine formaldehyde and epoxy-containing acrylate/acid.

The substrate can be any object that is substantially chemically stable at the operating temperature(s) of the coating process. It is preferred that the object also be dimensionally stable at the operating temperature(s) and times to avoid any dimensional changes such as those caused by melting or warping. The substrate can be coated with one or more other coating layers before coating by this process. For instance, a corrosion resistant and/or primer layer and/or a metal layer such as zinc (galvanized) can be employed. Preferred substrates are metals and plastics. Preferred metals are iron, steel, galvanized steel, electrogalvanized steel (one and two sides), phosphate-treated steel, electrogalvanized steel which is phosphate-treated, aluminum, and phosphate-treated aluminum. Preferred plastics are composites and compacted fibrous structures. Optionally, the fluidized bed may be vibrated to assist in powder fluidization.

The temperature of the substrate as it enters the fluidized bed of polymer particles is within the tack gradient when a thin coating is desired. Generally speaking, the temperature of the substrate will decrease toward the temperature of the fluidized bath, when the substrate is in the fluidized bath. The temperature of the fluidizing gas in the fluidized bed is below the tack temperature to avoid agglomeration of polymer particles before their contact with the heated substrate.

The coating is applied in a fluidized bed of polymer particles which are fluidized by the passage of a gas though the particles so as to form a reasonably uniform fluid mass. It is preferred that the polymer particles in the fluidized bed are not electrostatically charged to a degree that will cause their adherence to the substrate when the substrate is below tack temperature. A coherent and substantially continuous coating will usually have a thickness of at least about 5 micrometers. Preferred coatings of this invention are those described herein as "thin". Such coatings are from about 5 to 150 micrometers thick, preferably no more than about 75 micrometers and more preferably no more than 60 micrometers. Thicker coatings of between 150 to 300 micrometers utilizing the process of this invention are certainly possible but are less preferred.

Preferably, about eighty percent by weight of the coating particles are in a size range of about 10 micrometers to 80 micrometers, more preferably about 20 micrometers to 60 micrometers. It is most preferred that at least 90 weight percent of the polymer particles be in these size ranges. Substantially no particles will be larger than 200 to 250 micrometers. The particle size of the polymer is measured by the general technique described by Heuer, et al, Part. Charact., Vol. 2, pages 7 to 13 (1985). The measurement is made using a Vario/LA Helos analyzer available from Sympatec, Inc., 3490 U.S. Route 1, Princeton, N.J. 08540, U.S.A., using the volume percent measurement.

After removal from the fluidized bed, the coated substrate can be heated above the tack temperature gradient of the polymer to level the coating and effect cure if it is a thermosetting polymer. This is carried out in a typical heating apparatus such as a convection or infrared oven. If the polymer is thermosetting, it is preferred that substantial curing not take place before leveling has taken place. The time required for leveling will depend on the particle size, distribution, thickness, temperature used and the viscosity of the polymer. Higher temperatures and lower polymer viscosities favor faster leveling.

One advantage of this coating process is the ability to obtain relatively thin uniform coatings without the need for electrostatic or other forces to assist in adhering the polymer to the substrate. More uniform coverage of irregular and "hidden" surfaces is normally achieved by this method than by electrostatic methods. This more uniform coverage is attributed to control of particle size and particle size distribution as described herein, as well as the lack of inhibitory Faraday cage effect in an electrically charged system.

The coatings produced by the instant process are useful to impart corrosion resistance, chemical resistance, and other properties such as will readily occur to one skilled in the art. They can act as primers for a subsequent coating layer and/or provide pleasing aesthetic properties such as color, smoothness, and the like. To provide such advantages, it can be useful to include with or within the polymer particles other materials employed in polymer coatings such as fillers, reinforcers, pigments, colorants, antioxidants, corrosion inhibitors, leveling agents, antiozonants, UV screens, stabilizers, and the like. In many instances, coating attributes depend on good adhesion of the polymer coating to the substrate. Such adhesion can often be improved by commonly known methods such as use of a primer, cleaning of the substrate surface, chemical treatment of the substrate surface and/or modification of the chemical makeup of the coating being applied. In this latter category, for instance, when coating directly on metal, adhesion can often be improved by including polar groups in the coating polymer, such as carboxyl or hydroxyl groups. One or more surfaces of the substrate can be coated, as desired, by controlling immersion conditions.

The coatings applied by the process of this invention are useful in many applications, such as the coating of coil stock, automotive, truck and vehicle bodies, appliances, ceramic parts, plastic parts, and the like. For instance, for automotive bodies, the coatings can be applied directly onto the metal surface or a primer can be applied first. The coated body is thereby protected from corrosion and physical damage. One or more coating layers of typical finish coats such as a so-called (usually colored) basecoat, and then a clearcoat can be applied. Care should be taken to insure adequate adhesion between the various coats, and between the polymer coat and the metal body. Coating applications by the instant process can be relatively thin and uniform for good corrosion protection, while at the same time not adding much weight to the vehicle, nor using too much relatively expensive polymer. In addition, the coating will be smooth and uniform when measured, for instance, by a profilometer. This process gives substantially void-free coatings.

Generally, the temperature of the substrate (and any polymer coated on it) will decrease toward the temperature of the fluidized bath, when the substrate is in the fluidized bed. Preferred operating conditions include substrate temperatures of about 20° C. or more above Tt, not significantly exceeding about 40° C. or more above Tt (but below Tm). The temperature of the substrate as it enters the fluidized bed (at a temperature above the tack temperature) together with the appropriate size selection of coating particles largely governs the coating thickness independent of time, after a critical minimum dip time in the fluidized bed.

We have found that thin coatings can be obtained substantially independently of time (after a minimum residence time) utilizing the process of this invention. This is achieved by preheating the substrate within the tack temperature gradient, preferably close to Tt, and controlling particle sizes as described. When these variables are controlled within the teaching of this invention, increasing residence in the fluidized bed has little or no effect on coating thickness. The benefits of this invention are most important when dipping intricate objects or very large objects such as vehicle bodies. Without the benefits of this invention, dipping intricate objects for relatively long periods of time to achieve some coverage of all surfaces would produce too-thick coatings, and dipping large objects to achieve desirable thin coatings would produce nonuniform coating thicknesses.

The particles preferred for use in the process of this invention are substantially spherical in shape. Contemplated spherical particles can be made according to the teachings of U.S. Pat. No. 3,933,954 as improved herein. The process concerns shearing in a closed shear zone of a shear device under positive pressure water, ammonia and copolymer of α-olefins of the formula $R—CH{=}CH_2$, where R is a radical of hydrogen or an alkyl radical having from 1 to 8 carbon atoms, and α,β-ethylenically unsaturated carboxylic acids having from 3 to 8 carbon atoms. The copolymer is a direct copolymer of the α-olefins and the unsaturated carboxylic acid in which the carboxylic acid groups are randomly distributed over all molecules and in which the α-olefin content of the copolymer is at least 50 mol percent, based on the α-olefin-acid copolymer. The unsaturated carboxylic acid content of the copolymer is from 0.2 to 25 mol percent, based on the α-olefin-acid copolymer, and any other monomer component optionally copolymerized in said copolymer is monoethylenically unsaturated. A temperature is employed that is above the melting point but below the thermal degradation point of the polymer to form a homogeneous slurry wherein the polymer particles have an average particle size of less than 100 microns in diameter, the slurry containing at least 0.6% by weight ammonia and up to 50% by weight of said polymer; after completion of shearing, maintaining the slurry with agitation at a temperature above the polymer melting point for at least 0.5 minute until essentially all the polymer particles become spherical; while continuing agitation cooling the slurry to a temperature below about 80° C. in a period of at least 0.3 minute, the pressure maintained being sufficient to keep the water in the liquid state; simultaneous with or subsequent to cooling the slurry reducing the pressure of said cooled slurry to atmospheric pressure; and separating the polymer particles. The partially spherical-shaped particles have an average diameter of 10 to 100 microns and are characterized in that the surface of the particles may be rough and/or covered with hemispherical bumps about 0.1 micron in diameter, or with "dimples".

Contemplated polymers suitable for preparation as spheres by the lo process just described include ethylene, propylene, butene-1, pentene-1, hexene-1, heptene-1, 3-methylbutene-1, and 4-methylpentene-1. Ethylene is the preferred olefin. The concentration of the α-olefin is at least 50 mol percent in the copolymer and is preferred greater than 80 mol percent. Examples of α,β-ethylenically unsaturated carboxylic acids are acrylic acid, methacrylic acid, ethacrylic acid, itaconic acid, maleic acid, fumaric acid, monoesters of said dicarboxylic acids, such as methyl hydrogen maleate, methyl hydrogen fumarate, ethyl hydrogen fumarate and maleic anhydride. Although maleic anhydride is not a carboxylic acid in that it has no hydrogen attached to the carboxyl groups, it can be considered an acid for the purposes of the present invention because its chemical reactivity is that of an acid. Similarly, other α,β-monoethylenically unsaturated anhydrides of carboxylic acids can be employed. The preferred unsaturated carboxylic acids are methacrylic and acrylic acids. As indicated, the concentration of acidic monomer in the copolymer is from 0.2 mol percent to 25 mol percent, and, preferably, from 1 to 10 mol percent.

The copolymer base need not necessarily comprise a two-component polymer. More than one olefin can be employed to provide the hydrocarbon nature of the copolymer base. The scope of base copolymers suitable for use in the present invention is illustrated by: ethylene/acrylic acid copolymers, ethylene/methacrylic acid copolymers, ethylene/itaconic acid copolymers, ethylene/methyl hydrogen maleate copolymers, and ethylene/maleic acid copolymers, etc. Examples of tricomponent copolymers include: ethylene/acrylic acid/methyl methacrylate copolymers, ethylene/methacrylic acid/ethyl acrylate copolymers, ethylene/itaconic acid/methyl methacrylate copolymers, ethylene/methyl hydrogen maleate/ethyl acrylate copolymers, ethylene, methacrylic acid/vinyl acetate copolymers, ethylene/acrylic acid/vinyl alcohol copolymers, ethylene/propylene/acrylic acid copolymers, ethylene/styrene/acrylic acid copolymers, ethylene/methacrylic acid/acrylonitrile copolymers, ethylene/fumaric acid/vinyl methyl ether copolymers, ethylene/vinyl chloride/acrylic acid copolymers, ethylene/vinylidene chloride/acrylic acid copolymers, ethylene/vinyl fluoride/methacrylic acid copolymers, and ethylene/chlorotrifluoroethylene/methacrylic acid copolymers.

In addition to the third monomer component of the copolymer stated above, additional third monomeric components can be an alkyl ester of an α,β-ethylenically unsaturated carboxylic acid of 3 to 8 carbon atoms where the alkyl radical has 4 to 18 carbon atoms. Particularly preferred are the terpolymers obtained from the copolymerization of ethylene, methacrylic acid, and alkyl esters of methacrylic acid or acrylic acid with butanol. The concentration of this optional component is 0.2 to 25 mol percent, based on the weight of copolymer, preferably from 1 to 10 mol percent. Representative examples of the third component include n-butyl acrylate, isobutyl acrylate, sec-butyl acrylate, t-butyl acrylate, n-butyl methacrylate, isobutyl methacrylate, sec-butyl methacrylate, t-butyl methacrylate, n-pentyl acrylate, n-pentyl methacrylate, isopentyl acrylate, isopentyl methacrylate, n-hexyl acrylate, n-hexyl methacrylate, 2-ethylhexyl acrylate, 2-ethyl-hexyl methacrylate, stearyl acrylate, stearyl methacrylate, n-butyl ethacrylate, 2-ethyl hexyl ethacrylate. Also, the third component includes mono- and di-esters of 4 to 8 carbon atom di-carboxylic acids such as n-butyl hydrogen maleate, sec-butyl hydrogen maleate, isobutyl hydrogen maleate, t-butyl hydrogen maleate, 2-ethyl hexyl hydrogen maleate, stearyl hydrogen maleate, n-butyl hydrogen fumarate, sec-butyl hydrogen fumarate, isobutyl hydrogen fumarate, t-butyl hydrogen fumedrate, 2-ethyl hexyl hydrogen fumarate, stearyl hydrogen fumarate, n-butyl fumarate, sec-butyl fumarate, isobutyl fumarate, t-butyl fumarate, 2-ethyl hexyl fumarate, stearyl fumarate, n-butyl maleate, sec-butyl maleate, isobutyl maleate, t-butyl maleate, 2-ethyl hexyl maleate, stearyl maleate. The preferred alkyl esters contain alkyl groups of 4 to 8 carbon atoms. The most preferred contain 4 carbon atoms. Representative examples of the most preferred esters are n-butyl acrylate, isobutyl acrylate, n-butyl methacrylate, isobutyl methacrylate, t-butyl acrylate, t-butyl methacrylate.

The preferred base copolymers are those obtained by the direct copolymerization of ethylene with a monocarboxylic acid comonomer and can be neutralized or not neutralized.

It is preferred that spherical particles be employed in the disclosed process said particles comprising the base copolymers and the various additives found to lend desirable properties to the finish coatings.

PROCEDURES

Vibration of substrate(s) when employed was applied at 1000 to 2000 Hz with about 90 Newtons of force. The vibrator, known as VIBCO VS100® Vibra was mounted onto the part being dipped. The spherical particles described herein are "substantially spherical", that is, they have a smooth radius of curvature and almost no sharp edges such as characterize particles that are made by cryogenic grinding. One skilled in the art will appreciate that the substrates coated by the process of this invention can be pretreated or post-treated with various heating techniques including gas, electric, microwave, dielectric, infra-red, and the like.

EXAMPLES

In these Examples, the panels measured approximately 10.2 cm by 30.5 cm×686 micrometers (4 in×12 in×27 mils). AEROSIL® A972 fumed silica (Degussa), is present as a component of the coatings described hereafter in each of Examples 1 to 27 in an amount of 0.1 to 0.5 weight percent. More specifically, the amount in Examples 19 to 24 was 0.2%. Particles are reported in mean particle sizes.

Example 1

Panel: cold rolled steel, unpolished and rinsed with naphtha ABCITE® 1060 thermoplastic powder coating resin which is a DuPont product and is an ethylene/methacrylic acid copolymer and is sodium neutralized, Mw: 30,800

Preheat: In an electric oven to 100° C.

Standard fluid bed; 0.85 $m^3$/min (30 SCFM); 1 sec dip

Fluidized bed: 30 cm×60 cm

Particle size: 175 micrometer (mean); 100<80%<225

Tg=20° C., Tt=80° C., Tm=100° C.

Post heat: 200° C. for 10 min

Coating Thickness: 76±25 micrometers.

Examples 2 to 9

| Example Number | Preheat ° C. | Postheat ° C. | Coating Thickness (Micrometer) |
|---|---|---|---|
| 2 | 80 | 200 | 69 ± 38 |
| 3 | 90 | 200 | 71 ± 25 |
| 4 | 120 | 200 | 91 ± 38 |
| 5 | 140 | 200 | 102 ± 38 |
| 6 | 160 | 200 | 114 ± 51 |
| 7 | 180 | 200 | 127 ± 64 |
| 8 | 200 | 200 | 140 ± 64 |
| 9 | 250 | 200 | 229 ± 102 |

Examples 10 to 12

Panel: 2 sided electrogalvanized which is unpolished, phosphate-treated and rinsed with naphtha.

Polymer: FERRO VEDOC® 158E114 fluidized bed powder

Preheat: In an electric oven

Standard fluid bed; 0.01 to 0.015 $m^3$/min (0.35–0.5 SCFM); 1 sec dip

Fluidized bed: 15 cm diameter

Particle size: 28 micrometer (mean); 15<80%<40

Tg=50° C., Tt=90° C.

| Example Number | Preheat ° C. | Postheat ° C. | Coating Thickness (Micrometer) |
|---|---|---|---|
| Control* | 80 | 160/3 min | 5.0 very nonuniform |
| 10 | 90 | 160/3 min | 15 ± 0.25 |
| 11 | 100 | 160/3 min | 18 ± 0.25 |
| 12 | 110 | 140/10 min | 30 ± 0.25 |

*Preheat was below tack temperature

Example 13

Panel: Cold rolled steel, phosphate treated, unpolished phosphate-treated and rinsed with naphtha Polymer: Same as in Examples 10 to 12

Preheat: 110° C.

Voltage: 50KV

Electrostatic fluid bed; 14 $m^3$/min (500 SCFM); 1 sec dip; about 5.1 cm above the fluid bed Bed size: 36 cm×36 cm Particle size: 28 micrometer; 15<80%<40

Post heat: 160° C. for 30 min

Thickness: 76±18 micrometers.

Example 14

Panel: Cold rolled steel, which is unpolished, phosphate-treated and rinsed with naphtha Polymer: acid-containing polyester reacted with triglycidylisocyanurate supplied by Protech Preheat: In an electric oven to 100° C.

Standard fluid bed; 1.4 $m^3$/min (50 SCFM); 1 sec dip

Particle size: 26 micrometer; 10<60%<65

Tg=60° C., Tt=100° C.

Post heat: 160° C. for 30 min

Thickness: 30±12.5 micrometers

Bed size: 30 cm×60 cm.

Example 15

Panel: Aluminum which is unpolished, phosphate-treated and rinsed with naphtha

POLY VYNEL CHLORIDE® V12178 poly vinyl chloride supplied by Plastomeric Inc

Preheat: In an electric oven at 150° C.

Tg=50° C., Tt=150° C., Tm=185° C.

Standard fluid bed; 0.85 $m^3$/min (30 SCFM); 1 sec dip

Particle size: 105 micrometer; 80<60%<135

Post heat: 250° C. for 5 min

Thickness: 50±15 micrometers

Bed size: 30 cm×60 cm.

Example 16

Same as Example 15 but panel was not phosphate-treated.

Example 17

Panel: cold rolled steel which is unpolished, phosphate-treated and rinsed with naphtha Polymer: NYLON 11 polymides supplied by Elf Autochem Preheat: In an electric oven at 140° C.

Tg=50° C., Tt=140° C., Tm=190° C.

Standard fluid bed; 0.85 $m^3$/min (30 SCFM); 1 sec dip

Particle size: 117 micrometer; 80<60%<150

Post heat: 200° C. for 5 min

Thickness: 50±10 micrometers

Bed size: 30 cm×60 cm.

Example 18

Panel: 2 sided electrogalvanized which is unpolished, phosphate-treated and rinsed with naphtha Polymer: Polymer: NUCREL® 960 resin (polyethylene/methacrylic acid copolymer-Mw: 104,000) supplied by E.I. du Pont de Nemours and Company Preheat: In an electric oven at 90° C.

Tg=20° C., Tt=90° C., Tm=100° C.

Standard fluid bed; 0.85 $m^3$/min (30 SCFM); 1 sec dip and longer

Particle size: 21 micrometer; 10<80%<40

Post heat: 200° C. for 5 min

Thickness: 25±1.25 micrometers

Bed size: 30 cm×60 cm

Examples 19 to 24

Panel: Cold rolled steel, phosphate-treated and rinsed with naphtha;

Polymer: NUCREL® 599 resin (polyethylene/methacrylic acid copolymer-Mw: 73,300) supplied by E.I. du Pont de Nemours and Company Preheat: In an electric oven Tg=20° C., Tt=80° C., Tm=100° C.

Standard fluid bed; 0.55 $m^3$/min (20 SCFM)

Particle size: 127 micrometer; 35<80%<275

Post heat: 200° C. for 5 min

Bed size: 30 cm×60 cm

| Example Number | Preheat Temperature | Dip Time | Thickness (Micrometer) |
|---|---|---|---|
| 19 | 80° C. | 1 sec | 20 ± 5 |
| 20 | 90° C. | 1 sec | 21 ± 1.25 |
| | | 3 | 30 ± 2.5 |
| 21 | 115° C. | 1 sec | 75 ± 10 |
| | | 3 | 138 ± 12.5 |
| 22 | 140° C. | 1 sec | 75 ± 12.5 |
| | | 3 | 188 ± 25 |
| | | 5 | 203 ± 37.5 |
| 23 | 165° C. | 1 sec | 83 ± 20 |
| | | 5 | 325 ± 62.5 |
| 24 | 190° C. | 1 sec | 100 ± 50 |
| | | 5 | 375 ± 100 |
| | | 15 | 450 ± 125 |

Heating for longer dip times than noted does not increase coating thickness substantially Example 25

Panel: Cold Steel, unpolished; rinsed with naphtha

Polymer 200S W2752Z poly prepylene supplied by Micro Rowders, Inc

Preheat: In an electric oven at 150° C.

Tg=50° C., Tt=150° C., Tm=165° C.

Standard fluid bed; 0.85 $m^3$/min (30 SCFM); 1 sec dip

Particle size: 47 micrometer; 20<80%<80

Post heat: 200° C. for 3 min

Thickness: 50±0.5 micrometer

Bed size: 30 cm×60 cm.

Example 26

The procedure of Example 18 was followed except:

Panel: Cold rolled steel, phosphate-treated

Preheat: In an electric oven at 90° C.

Particle size: 135 micrometers mean: 30<80%<270 micrometers

Thickness: 75±37 micrometers

Example 27

The procedure of Example 26 was followed except: Preheat: In an electric oven at 200° C. Thickness: 137±30 micrometers.

Example 28

The procedure employed was as in Example 19 except as follows: No fumed silica, Polymer: SURLYN® ionomer resin (polyethylene/methacrylic acid copolymer-Mw 115, 000) supplied by E.I. du Pont de Nemours and Company (spherical particles), Particle size: 70 micrometer; 25<80%<110. Post heat: 180° C. for 5 minutes. Dip time: 1 sec dip. Thickness: 20±2 microns.

Example 29

The procedure as in Example 28 was followed except: Dip time is 15 seconds. Thickness: 60±5 microns.

Example 30

The procedure as in Example 28 was followed except: A vibrator was mounted onto the panel. Dip time 15 seconds. Thickness: 20±2 microns.

Example 31

The procedure as in Example 28 was followed except: The polymer as in Example 1. Vibrator mounted. Dip time 15 seconds. Thickness is 200±30 microns.

Example 32

The procedure as in Example 31 was followed except: Fumed silica at 0.2% was added. Thickness is 25±2 microns.

Example 33

As in Example 19 except the substrate is polyethylene terephthalate reinforced within carbon fibers (60%). Dimensions are 10.2 cm by 30.5 cm by 1.5 mm. Coating Thickness: 70 micrometers±25 micrometers.

Example 34

As in Example 19 except the substrate is polypyromellitimide. Dimensions are 10.2 cm by 30.5 cm by 225 micrometer. Coating Thickness: 68 micrometers±25 micrometers.

For best results in obtaining coatings within the description provided above, at least one element from Groups I and III will be employed. Group II vibration is effective only with one or both of the elements of Groups I and III. The most preferred process employs vibration of substrate (Group II) and spherical particles (Group III).

TABLE

| Fumed Silica | Vibration of Part | Spherical Particles |
|---|---|---|
| I | II | III |
| Yes | No | No |
| No | No | Yes |
| No | Yes | Yes** |
| Yes | Yes | No |
| Yes | No | Yes |
| Yes | Yes | Yes* |

*= Preferred
**= Most Preferred

What is claimed is:

1. An improved process for coating a substrate with a polymer comprising heating said substrate, immersing said heated substrate into a fluidized bed of particles of the polymer, coating the substrate with the polymer and removing the coated substrate from the fluidized bed;

wherein the improvement comprises:

i) heating the substrate during said heating step to a temperature sufficient to tackify the polymer particles upon contact;

ii) maintaining particle temperature in the fluidized bed below that at which the particles tackify;

iii) covering substantially uniformly all surfaces of the heated substrate;

iv) optionally heating the coated substrate to level the coating and to cure the polymer if it is thermosetting; and v) controlling the coating thickness, per unit time, to obtain thin coatings of up to 150 micrometers, by heating the substrate such that the coating temperature is within the tack temperature gradient but below Tm and maintaining particle sizes so that at least 80 weight percent are between 10 to 80 micrometers.

2. An improved process for coating a substrate with a polymer comprising heating said substrate, immersing said heated substrate into a fluidized bed of particles of the polymer, coating the substrate with the polymer and removing the coated substrate from the fluidized bed;

wherein the improvement comprises:

i) heating the substrate during said heating step to a temperature sufficient to tackify the polymer particles upon contact;

ii) maintaining particle temperature in the fluidized bed below that at which the particles tackify;

iii) covering substantially uniformly all surfaces of the heated substrate; controlling the coating thickness, per unit time by:

(a) heating the substrate within the tack temperature gradient but below Tm and by maintaining particle sizes of at least 80 weight percent of said polymer particles between 10 to 80 micrometers to obtain thin coatings of up to 150 micrometers; or (b) heating the substrate above the tack temperature gradient, maintaining particle sizes of at least 80 weight percent of said polymer particles above 80 micrometers, or both to obtain thicker coatings of between 150 to 300 micrometers.

3. The process according to claim 1 or 2 wherein the polymer is at least one thermoplastic polymer selected from the group consisting of polyolefin polymers and copolymers, polymethylmethacrylates, polymethacrylates, polyesters, and polyvinyl chloride.

4. The process according to claim 1 or 2 wherein the polymer is at least one thermosetting polymer selected from the group consisting of acid-containing polyester/epoxy, hydroxy acrylate/blocked isocyanate or melamine formaldehyde and epoxy-containing acrylate/acid.

5. The process according to claim 1 wherein the polymer is crystalline.

6. The process according to claim 1 wherein the polymer is amorphous.

7. The process according to claim 1 employing one or more of spherical particles of coating polymer; vibrating the substrate during step (iii); and employing fumed silica as a component of the fluidized bed.

8. The process according to claim 7 employing spherical particles and vibrating the substrate.

9. The process according to claim 3 wherein the particles comprise one or more materials selected from the group consisting of fillers, reinforcers, pigments, colorants, antioxidants, corrosion inhibitors, leveling agents, antiozonants, UV screens and stabilizers.

10. The process according to claim 4 wherein the particles comprise one or more materials selected from the group consisting of fillers, reinforcers, pigments, colorants, antioxidants, corrosion inhibitors, leveling agents, antiozonants, UV screens and stabilizers.

11. A process for producing a thin coating of up to 150 micrometers of a polymer on a substrate comprising:

heating the substrate to a temperature sufficient to tackify the polymer upon contact;

immersing the heated substrate in a fluidized bed of particles of the polymer to substantially uniformly cover all surfaces of the substrate with the polymer particles, said particles being maintained below the temperature at which said particles tackify; and removing the coated substrate from the fluidized bed to produce said thin coating thereon, wherein thickness of said thin coating is controlled by maintaining the temperature of the substrate above the tack temperature gradient but below Tm of said polymer and by using at least 80 weight percent of the polymer particles having particle sizes in the range of 10 to 80 micrometers.

12. A process for controlling thickness of a coating of a polymer on a substrate to up to 150 micrometers, said process comprising:

heating the substrate to a temperature above the tack temperature gradient but below Tm of said polymer; and immersing the heated substrate in a fluidized bed of particles of the polymer to substantially uniformly cover all surfaces of the substrate with the polymer particles; wherein at least 80 weight percent of the polymer particles are of particle sizes in the range of 10 to 80 micrometers and wherein said particles are maintained below the temperature at which said particles tackify.

13. The process of claim 12 further comprising removing the coated substrate from the fluidized bed to produce said coating thereon.

14. The process of claim 11 or 12 further comprising heating said coated to substrate to level said coating thereon.

15. The process of claim 1, 2, 11 or 12 wherein said polymer is a thermosetting polymer.

16. The process of claim 15 further comprising heating said coated to substrate to level and cure said coating thereon.

17. The process according to claim 11 or 12 wherein the polymer is at least one thermoplastic polymer selected from the group consisting of polyolefin polymers and copolymers, polymethylmethacrylates, polymethacryates, polyesters, and polyvinyl chloride.

18. The process according to claim 17 wherein the particles comprise one or more materials selected from the group consisting of fillers, reinforcers, pigments, colorants, antioxidants, corrosion inhibitors, leveling agents, antiozonants, UV screens and stabilizers.

19. The process according to claim 11 or 12 wherein the polymer is at least one thermosetting polymer selected from the group consisting of acid-containing polyester/epoxy; hydroxy acrylate/blocked isocyanate or melamine formaldehyde; and epoxy-containing acrylate/acid.

20. The process according to claim 19 wherein the particles comprise one or more materials selected from the group consisting of fillers, reinforcers, pigments, colorants, antioxidants, corrosion inhibitors, leveling agents, antiozonants, UV screens and stabilizers.

21. A process for producing a thick coating of above 150 micrometers of a polymer on a substrate comprising:

heating the substrate to a temperature sufficient to tackify the polymer upon contact;

immersing the heated substrate in a fluidized bed of particles of the polymer to substantially uniformly cover all surfaces of the substrate with the polymer particles, said particles being maintained below the temperature at which said particles tackify; and removing the coated substrate from the fluidized bed to produce said thick coating thereon, wherein thickness of said thick coating is controlled by maintaining the temperature of the substrate above the tack temperature gradient, employing at least 80 weight percent of the polymer particles having particle sizes above 80 micrometers, or both.

* * * * *